United States Patent [19]

Lovelace, Jr.

[11] Patent Number: 4,682,800

[45] Date of Patent: Jul. 28, 1987

[54] LATCH ASSEMBLY

[75] Inventor: Charles B. Lovelace, Jr., Upland, Calif.

[73] Assignee: Lockheed Corporation, Calabasas, Calif.

[21] Appl. No.: 748,649

[22] Filed: Jun. 25, 1985

Related U.S. Application Data

[63] Continuation of Ser. No. 550,827, Nov. 14, 1983, abandoned.

[51] Int. Cl.[4] ..... E05C 5/02

[52] U.S. Cl. ..... 292/247; 292/DIG. 49

[58] Field of Search ..... 292/112, 246, 247, 113, 292/341.18, DIG. 31, DIG. 49, 96, 240, 241, 190; 52/127.7, 127.8, 127.9, 584

[56] References Cited

U.S. PATENT DOCUMENTS

| | | | |
|---|---|---|---|
| 2,036,151 | 3/1936 | Lang | 292/112 |
| 2,265,691 | 12/1941 | Hogg | 292/341.18 |
| 2,712,955 | 7/1955 | Andrews | 292/113 |
| 2,939,734 | 6/1960 | Claud-Mantle | 292/112 X |
| 3,254,517 | 6/1966 | Wheeler | 292/240 X |
| 3,514,142 | 5/1970 | Smith | 292/113 |
| 4,053,177 | 10/1977 | Stammreich et al. | 292/113 |

*Primary Examiner*—Richard E. Moore

*Attorney, Agent, or Firm*—Eric R. Katz

[57] ABSTRACT

An adjustable over-center latching assembly (11) for securing aircraft panels (13A, 13B) is operated by a worm shaft (21) and segmental gear (25) in order to obtain the rotational directional change required to move a latching member (15) into and out of engagement with a keeper (17). A secondary locking feature is provided due to the irreversible nature of the gear and worm arrangement.

3 Claims, 5 Drawing Figures

LATCH ASSEMBLY

This is a continuation of application Ser. No. 550,827, filed Nov. 14, 1983, now abandoned.

TECHNICAL FIELD

This invention generally relates to a latch assembly and more particularly, to an adjustable, flush mounted, over center latch assembly having a secondary locking feature.

BACKGROUND ART

Aircraft are provided with a substantial number of outwardly exposed, flush mounted panels. Typically, these panels are removable or hinged to the surrounding surface of the aircraft to provide, for example, an opening for accessing the engine of the aircraft, particularly for maintenance thereon. Various types and designs of latch assemblies have been used to secure these flush mounted panels in place.

One such latch assembly is the over center hook latch as shown, for example, in U.S. Pat. No. 2,712,955. In this particular latching assembly, the fulcrum axis of the latch handle is mounted to a bracket on the aircraft panel and the latch hook engages a keeper on the aircraft structure. The latch is designated as an over center latch because, in the closed position, the load on the latch handle creates a moment arm on the latch handle about the fulcrum axis in a direction which maintains the latch in its closed position.

Known over center latch assemblies have primarily employed lever arms or cam action to provide the necessary pull-up force required to bring the complementary panel components together. While operationally quite efficient, these arrangements do possess certain definite disadvantages. Due to high operational friction, the pull-up capabilities of the latch assemblies of the type concerned here are poor, thus often requiring the exertion of an inordinate amount of force in order to operate the latch.

Another disadvantage of the known latch assemblies, such as that disclosed by U.S. Pat. No. 4,053,177, is that the upper surface of the latch handle is mounted so as to be flush with the outer skin of the aircraft when the latch is in the closed position. While this configuration does mitigate air flow disturbances in the vicinity of the latch assembly, the resulting external surface roughness of this type of flush mounted latch assembly generates large surface area aerodynamic disturbances which increase drag as well as cause undesirable flow characteristics.

Additionally, due to the high forces exerted on the suface of the aircraft, proper adjustment between the hook latch and corresponding keeper arm is critical and must be maintained. If the distance is too great, the latch either will not close or will create excessive compressional forces on the aircraft components resulting in possible damage to the components or latch. If the distance is too close, the hook will not engage the keeper with suitable tension to maintain the panel on the aircraft, thus resulting in a questionable locking condition.

Because of the possible damage or even total loss of an aircraft should the latch fail. great care is exercised to make sure that the latch is secure and that any play or free movement between the hook latch and its keeper is eliminated. While latching assemblies are known having means for providing such adjustment when the latch is either engaged or disengaged, poor adjustment capabilities have resulted due to the limited amount of adjustable travel offered by the known adjustment arrangements.

Also, the known latching assemblies are, typically, configured with numerous moving parts which not only diminish the reliability of operation of the latch, but also make the replacement of the component parts of the latch difficult, particularly while the latch assembly is installed in the panel. Furthermore, the the feature of a secondary locking capability incorporated into the normal operation of the latch to provide back-up locking is, heretofore, unknown.

DISCLOSURE OF THE INVENTION

It is, therefore, an object of the present invention to provide an over center latch assembly having a secondary locking feature incorporated into the normal operation of the latch.

Another object is to provide a flush mounted latch assembly which is operated by a conventional drive tool adapted for insertion through a small opening in the panel, the remaining components of the latch assembly being concealed by the panel.

A further object is to provide a flush mounted, over center latch assembly adapted for low friction operation while providing improved pull-up capabilities.

Yet another object of the present invention is to provide a flush mounted, over center latch assembly which is economical and feasible to manufacture.

The principal feature of the present invention is the provision of a totally new approach for providing pull-up capabilities in an over-center latch assembly, which function is now accomplished in the art by means of levers, cam action or the like. In accordance with the present invention, operation of the latch assembly is faciliated by a worm shaft and segmental gear wheel as a simple means to obtain the rotational directional change required to move the latch hook into and out of engagement with the keeper.

A further important feature of the invention is the provision of a worm shaft and segmental gear wheel assembly as described which provides a secondary locking capability incorporated into the normal operation of the latch assembly. A major difficulty and consequent expense of present over-center latch assemblies has been the need to provide a separate secondary locking arrangement to assure against inadvertent separation of the latch assembly. Such arrangements must, necessarily, be situated within the latch assembly, thus complicating the overall mechanism. In accordance with the invention, the irreversible nature of the worm gearing arrangement provides the secondary locking feature.

In addition to the highly desirable feature of secondary locking, the invention is further characterized by the ability to replace the component parts of the latch assembly while installed in the panel.

In accordance with these and other objects, advantages and features of the present invention, there is provided an adjustable over-center, flush-mounted latch assembly for securing cowling panels comprising a manually operated shaft provided with a worm, the worm shaft being secured to one of the panels for rotational movement. A segmental gear, which meshes with and is operated by the worm, has a first shaft defining a first pivot axis about which the gear rotates. A latching member is pivotally connected to the segmental gear by a second shaft defining a second pivot axis about which the latching member pivots. The latching member is provided with engaging means, at its distal end, for engaging a keeper and at its proximal end with a shoulder. A lug is positioned on the face of the segmental gear for engaging the shoulder of the latching member when the gear is rotated to an open position. Biasing means for biasing the latch member towards a closed position is also included as well as adjusting means for adjusting the keeper relative to the latching member. In operation, the rotation of the worm shaft in a first direction causes the second shaft of the latching member to pass over dead center of the first shaft to thereby begin to release the load on the keeper. Continued rotation of the worm shaft in the first direction relieves all of the latch load and causes the lug to engage the shoulder of the segmental gear thereby overcoming the bias of the biasing means and rotating the latch member out of engagement with the keeper.

DESCRIPTION OF THE DRAWINGS

For a fuller understanding of the nature and objects of the invention, reference should be had to the following detailed description taken in connection with the accompanying drawings in which.

BEST MODE FOR CARRYING OUT THE INVENTION

Figure 1:
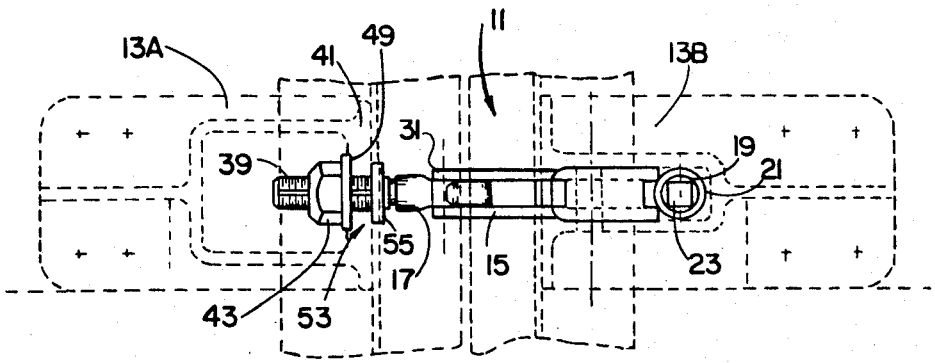
FIG. 1 is a plan view of the latch assembly of the present invention with portions broken away and in section, showing the latch set in a panel structure, the surround structure being shown fragmentarily.
Figure 2:
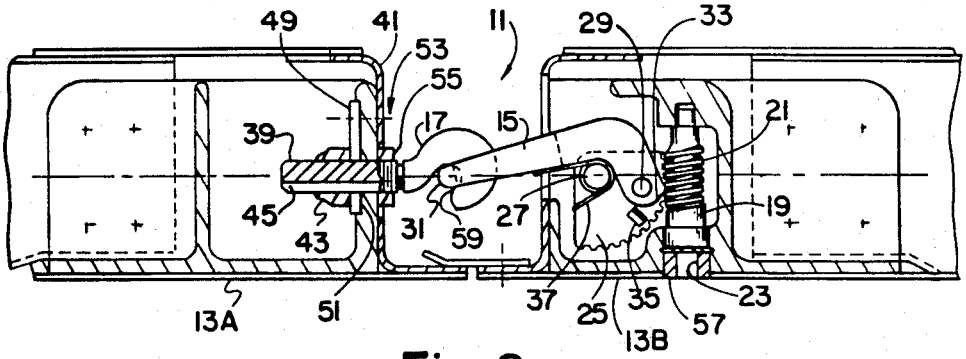
FIG. 2 a longitudinal sectional view through 2—2 of FIG. 1 showing the latch in its closed position.
Figure 3:
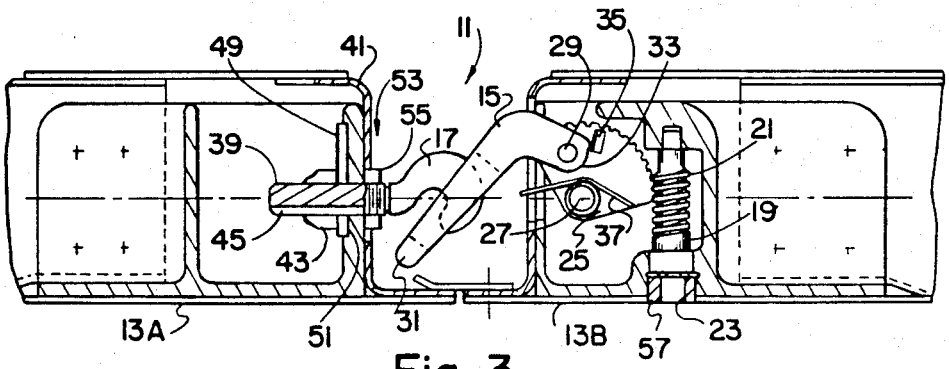
FIG. 3 is a longitudinal sectional view similar to FIG. 2, but showing the latch in its open position.

FIGS. 1–3 illustrate the latch assembly, generally indicated at 11, of the present invention in combination with an aircraft structure with which it is preferably used, however it is understood that the latch could also be used for other purposes. The aircraft structure, as illustrated, comprises a pair of panel members 13A, 13B which are, for example, secured by hinges to the frame of the aircraft.

The latch assembly 11, which secures the panels 13A, 13B in the closed position, comprises a latching member or link 15 having a substantially L-shaped configuration as seen in FIGS. 2–3 and a keeper or hook 17. The latching member 15 is moved into and out of engagement with the keeper 17 by means of a manually operated shaft 19 having a worm 21. The worm shaft 19, which is secured to one of the hinged panels 13B, is rotatable in a first direction to move the latching member 15 to an open position and in a second direction to move member 15 to a closed position so as to engage the latching member 15 with the keeper 17. In order to operate the worm shaft 19, a socket 23 is adapted to accept a standard insertable wrench. Alternatively, the socket 23 takes the form of a nut which is rotatably driven by a standard socket and drive arrangement.

A segmental gear 25 is operated by the worm 21. The gear 25 is provided with a first shaft 27 which defines a first pivot axis about which the gear 25 rotates. The latching member 15 is pivotally connected to the gear 25 by a second shaft 29 which defines a second pivot axis about which the latching member 15 pivots.

The latching member 15 is provided, at its distal end, with engaging means 31 for engaging the keeper 17. A shoulder 33 is provided at the proximal end of the member 15 for engaging a lug or protrusion 35 formed on the face of the segmental gear 25. The lug 35 is positioned on the gear 25 so as to engage the shoulder 35 of the latching member 15 when the gear 25 is rotated to the open position.

About first axis 27 is a biasing means 37 for biasing the latching member 15 towards the closed position. In the embodiment illustrated, biasing means 37 takes the form of a torsion spring: however, any other suitable biasing means can be employed, such as a conventional wire spring.

As illustrated, keeper 17 includes an integrally formed, threaded bolt shank 39. The keeper 17 is removably attached to the other of the panel members 13A by inserting the shank 39 through an aperture provided in panel portion 41 and tightening tension nut 43.

Figure 4:
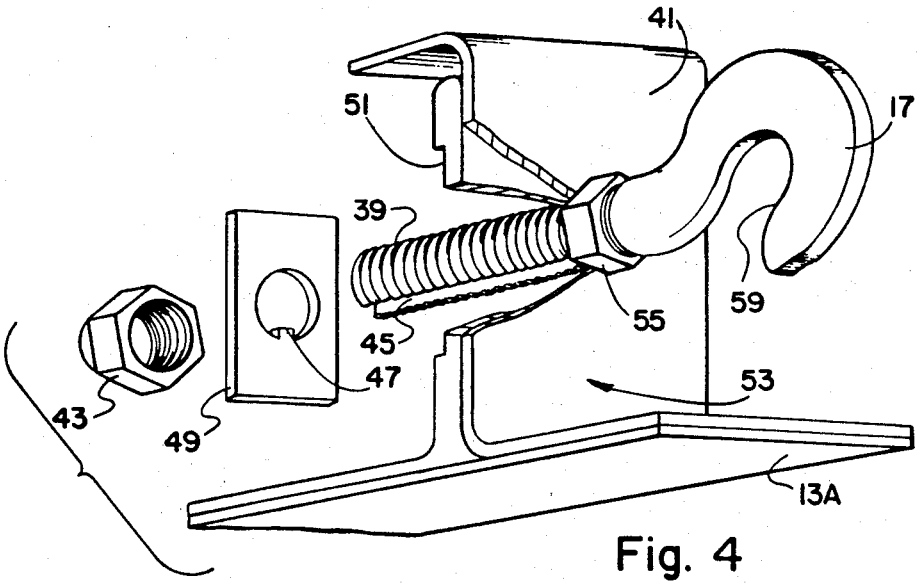
FIG. 4 is an isometric exploded view of the components for adjusting the latch illustrated in FIG. 1.
Figure 5:
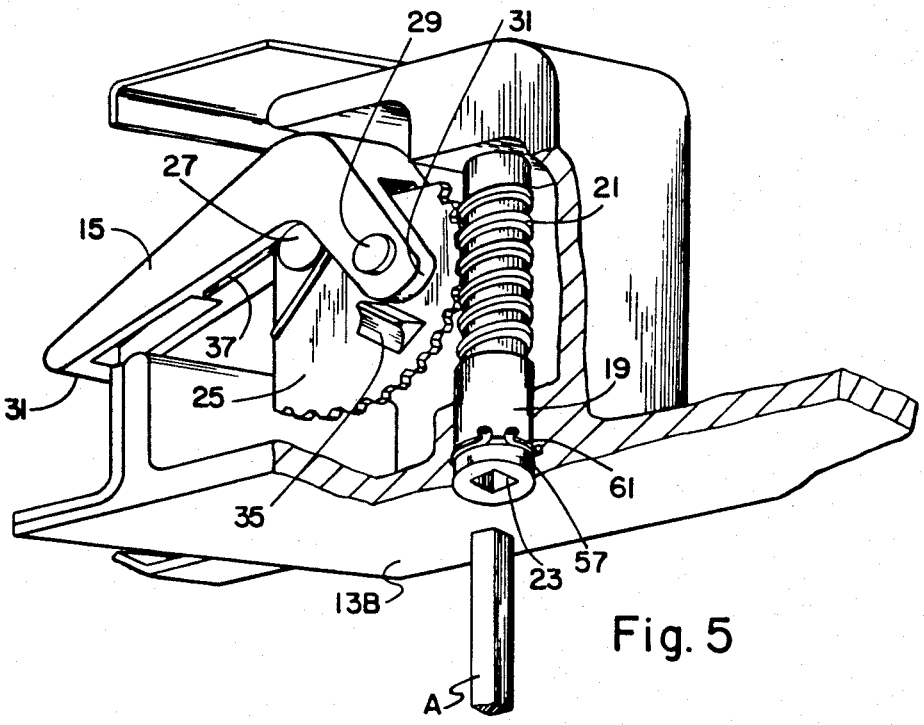
FIG. 5 is an elevated perspective view illustrating the worm gear and latch member arrangement of the present invention.

In order to provide proper alignment of the keeper 17 with respect to the latching member 15, a key-way or slot 45, as is best shown in FIG. 4, cooperates with tooth 47 of locking tab 49. Proper positioning of the locking tab 49 is achieved by means of a recess 51 provided in panel portion 41.

Adjustment of the keeper 17 relative to the latching member 15 is provided by adjusting means, generally indicated at 53. Movement of the keeper 17 towards and away from the latching member 15 is facilitated by turning tension nut 43 until the proper tension is established and then tightening jam nut 55.

Referring to FIGS. 2 and 3, the operation of the latch assembly 11 is quite straight forward. The only tool required is a standard wrench A, such as, for example, an allen wrench which is inserted into socket 23 to rotate shaft 19, an external hole 57 being provided in panel 13B to allow access of the tool A. Rotation of the worm 21 in, for example, the counter clockwise direction, drives the gear 25 in an opening direction causing second shaft 29 to pass over dead center of the first shaft 27 to being releasing the load on keeper 17. Continued rotation of the worm 21 relieves all of the link load and causes lug 37, on the face of the gear 25, to strike shouldder 33 on the proximal end of latching member 15. As lug 35 engages shoulder 33, the biasing of biasing means 37 is overcome and engaging means 31 is rotated out of link slot 59. This allows the pair of panel members 13A, 13B to be separated.

After the panel members 13A, 13B are brought back together, rotation of the worm 21 in the opposite direction, for example, in the clockwise direction, allows biasing means 37 to drive the engaging means 31 of latching member 15 back into slot 59 of keeper 17. Continued rotation in this direction pulls the panels 13A, 13B, together until second shaft 29 reaches dead center over the first shaft 27. Further operation moves second shaft 29 past dead center thus locking the latch assembly 11 in the closed position. Because latch assembly 11 is driven by a worm and gear arrangement, an irreversible condition is established thus providing a secondary lock.

One particular feature and a significant advantage of the latch assembly 11 is the ability to replace the component parts of the assembly 11, while installed in the panels 13A and 13B. By removing tension nut 43 from shank 39, keeper 17 is removed from panel 13A in a simple operation. Snap ring 61, as best seen in FIG. 4, is removed to replace worm shaft 19, while gear 25 is removed by tapping out first shaft 27. Similarly, second shaft 29 is tapped out in order to remove latching member 15 from gear 25.

While the present invention has been described with reference to a particular embodiment, it is understood that various changes in form and detail may be made therein without departing from the spirit and scope of the appended claims.

What is claimed is:

1. An adjustable over-center latching assembly having an open and a closed position comprising:

(a) a manually operated worm shaft provided with a worm, said shaft being rotated in a first direction to move said assembly to an open position and in a second direction to move said assembly to a closed position;

(b) a segmented gear meshing with and operated by said worm, said segmental gear having a first shaft defining a first pivot axis about which said gear rotates;

(c) a latching member pivotally connected to said segmental gear by a second shaft defining a second pivot axis about which said latching member pivots;

(d) engaging means at the distal end of said latching member and a shoulder at the proximal end of said latching member;

(e) a lug on the face of said segmental gear for engaging said shoulder of said latching member as said segmental gear is rotated to said open position;

(f) biasing means for biasing said latching member towards said closed positon;

(g) a keeper for engagement with and disengagement from said latching member; and (h) adjusting means for adjusting the distance of the latch keeper relative to said latching member;

whereby rotation of said manually operated worm shaft in said first direction causes said segmental gear to pivot about said first pivot axis to move said second shaft over dead center of said first shaft to thereby begin to release the load on said keeper, such that continued rotation of said manually operated shaft in said first direction relieves all of the link load and causes said lug to engage said shoulder of said segmental gear thereby overcoming the bias of said biasing means and rotating said latching member about said second shaft and out of engagement with said keeper.

2. A latch assembly according to claim 1, wherein said adjusting means comprises:

(a) a threaded shank integral with said keeper, said shank having a slot extending along the length thereof;

(b) a locking tab having a tooth for engaging the slot of said shank, said tab properly positioning said keeper with respect to said latching member;

(c) a tension nut for threadingly engaging said shank so as to vary the operative length of said shank; and (d) a jam nut for securing said threaded shank in a fixed position to a panel portion.

3. In combination with an aircraft having outwardly exposed panels which are subjected to aerodynamic loads and provide access to an interior portion of the aircraft, an adjustable, over-center latching assembly affixed to the interior portion of the panels so as to be concealed by the panels when the panels are closed and positioned on the panels so as to have an open and closed position comprising:

(a) a manually operated worm shaft provided with a worm, said shaft being rotated in a first direction to move said assembly to an open position and in a second direction to move said assembly to a closed position, one of the exposed panels having an aperture for permitting access to said shaft for manual operation thereof;

(b) a segmented gear meshing with and operated by said worm, said segmental gear having a first shaft defining a first pivot axis about which said gear rotates;

(c) a latching member having a substantially L-shaped configuration, the proximal end of which is pivotally connected to said segmental gear by a second shaft defining a second pivot axis about which said latching member pivots, said second pivot axis and said latching member being positioned in the closed position to create a moment arm on said latching member about said first shaft in a direction which mantains said latching member in the closed position; engaging means at the distal end of said latching member and a shoulder at the proximal end of said latching member;

(d) a lug on the face of said segmental gear for engaging said shoulder of said latching member as said segmental gear is rotated to said open position;

(e) biasing means for biasing said latching member towards said closed position;

(f) a keeper for engagement with and disengagement from said latching member; and (g) adjusting means for adjusting the distance of the latch keeper relative to said latching member;

whereby rotation of said manually operated worm shaft in said first direction causes said segmental gear to pivot about said first pivot axis to move said second shaft over dead center of said first shaft to thereby begin to release the load on said keeper, such that continued rotation of said manually operated shaft in said first direction relieves all of the link load and causes said lug to engage said shoulder of said segmental gear thereby overcoming the bias of said biasing means and rotating said latching member about said second shaft and out of engagement with said keeper.

* * * * *